US007295178B2

(12) United States Patent
Nakano et al.

(10) Patent No.: US 7,295,178 B2
(45) Date of Patent: Nov. 13, 2007

(54) DISPLAY APPARATUS AND DISPLAY METHOD

(75) Inventors: Taketoshi Nakano, Kawasaki (JP); Toshihiro Yanagi, Nara (JP); Takafumi Kawaguchi, Taki-gun (JP)

(73) Assignee: Sharp Kabushiki Kaisha, Osaka (JP)

( * ) Notice: Subject to any disclaimer, the term of this patent is extended or adjusted under 35 U.S.C. 154(b) by 216 days.

(21) Appl. No.: 10/617,386

(22) Filed: Jul. 11, 2003

(65) Prior Publication Data

US 2004/0051706 A1 Mar. 18, 2004

(30) Foreign Application Priority Data

Jul. 11, 2002 (JP) ..... 2002-202940

(51) Int. Cl.
*G09G 3/36* (2006.01)

(52) U.S. Cl. ..... 345/98; 345/205

(58) Field of Classification Search ..... 345/55, 345/56, 87, 98, 100, 205
See application file for complete search history.

(56) References Cited

U.S. PATENT DOCUMENTS

| | | | | |
|---|---|---|---|---|
| 5,349,368 | A * | 9/1994 | Takeda et al. | 345/684 |
| 5,576,731 | A * | 11/1996 | Whitby et al. | 345/100 |
| 5,719,593 | A * | 2/1998 | De Lange | 345/422 |
| 5,867,160 | A * | 2/1999 | Kraft et al. | 715/803 |
| 2001/0033278 | A1 | 10/2001 | Ohta et al. | |
| 2001/0052887 | A1 | 12/2001 | Tsutsui et al. | |
| 2002/0011998 | A1 | 1/2002 | Tamura | |
| 2003/0122773 | A1 | 7/2003 | Washio et al. | |

FOREIGN PATENT DOCUMENTS

| | | | |
|---|---|---|---|
| JP | 05-188885 | | 7/1993 |
| JP | 5-188885 | | 7/1993 |
| JP | 10-049058 | * | 2/1998 |
| JP | 11-184434 | | 7/1999 |
| JP | 2000-112435 | | 4/2000 |
| JP | 2001-356746 | A | 12/2001 |
| JP | 2003006694 | * | 1/2003 |

OTHER PUBLICATIONS

Korean Office Action and English translation thereof mailed May 7, 2005 in corresponding Korean application No. 10-2003-0046772.
CN 1345438A dated Apr. 17, 2002 (U.S. counterpart US 2002/0011998 listed above).
Chinese Office Action mailed Aug. 19, 2005 (w/English translation thereof).

* cited by examiner

*Primary Examiner*—Amr A. Awad
*Assistant Examiner*—Tom V Sheng
(74) *Attorney, Agent, or Firm*—Nixon & Vanderhye, PC

(57) ABSTRACT

A display apparatus of the present invention is provided with (i) a second memory for storing therein data of one frame for a whole display area of a display section, (ii) a first memory, provided in addition of the second memory, for storing therein data of one frame for a partial display area, (iii) a control section for causing the data respectively read out from the memories, to be respectively written in the display areas to which the data correspond to, and casing the partial display area to move to an predetermined position within a display screen of the display section, when a predetermined time lapses. The display apparatus has an improved display quality by moving the partial display area without affecting an image displayed in an area other than the partial display area.

17 Claims, 11 Drawing Sheets

DISPLAY APPARATUS AND DISPLAY METHOD

FIELD OF THE INVENTION

The present invention relates to a display apparatus and a display method using a partial driving method in which part of a display screen is activate and the other part is inactivate, relating to a hold-type display apparatus such as a liquid crystal display apparatus.

BACKGROUND OF THE INVENTION

Liquid crystal display apparatuses, which have been improved to have high definition and full color display, are mainly used as display apparatuses for use in portable telephones as portable terminal apparatuses. Such high definition and full color display gives the liquid crystal display apparatuses a higher power consumption.

Further, in such portable telephones, reduction in power consumption of the liquid crystal display apparatuses lowers overall power consumption of the portable telephones.

For those reasons, a partial driving method has been suggested. The partial driving method is a driving method in which part of a screen of a liquid crystal display apparatus is activate while the other part is inactive so as to have a lower power consumption for displaying.

In a portable telephone using the partial driving method, part of area (partial display area) in a screen of a liquid crystal display apparatus displays information that need to be overwritten as needed, such as time and radio wave condition, while the other area that is inactivate displays information that need not be overwritten, for example, displays white, black, or the like, simply.

That is, the portable telephone using a conventional partial driving method is poor in versatility and attractiveness, because content to be displayed on the display screen of the liquid crystal display apparatus during a waiting period is fixed.

In view of this, for example, Japanese Publication of Unexamined Patent Application, Tokukai, No. 2000-112435 (published on Apr. 21, 2000) discloses an art in which at least one of a position, an area, and display content part of area (partial display area in a screen of a display apparatus is changed at a certain time interval, by changing the partial display area at a time interval as such, the display becomes more attractive.

However, the art disclosed in the publication has the following problems.

Because the partial display area moves on an inactive display area, an area from which the partial display area has moved need be converted to an inactivate display area, so as to look as same as other inactive display area. Here, this conversion is carried out by turning on and off switching elements for liquid crystals, so as to have a white display or a black display in the inactive display area. Because of this, it is impossible to display on the inactive area an image that a user desires.

Even if the image that a user desire is displayed in the inactive display area, the area from which the partial display area has moved becomes a white display or a black display after the partial display area is moved. This deteriorates display quality of the display screen.

SUMMARY OF THE INVENTION

The present invention is made in view of the forgoing problems, and has an object of providing a display apparatus and display method whose display quality is improved by moving a partial display area without affecting an image displayed in an area other than the partial display area.

In order to attain the object, a display apparatus of the present invention is provided with an image display section for performing display of data written in the image display section, the data being held thereon for a predetermined holding period; a full screen memory for storing therein data of at least one frame for a whole display area of the image display section; a partial screen memory, provided in addition to the full screen memory, for storing therein data of at least one frame for a partial display area; an image-display-section refreshing section for refreshing the data written in the image display section; a partial-display-area refreshing section for refreshing data written in the partial display area, after the data is held for a period shorter than the holding period of the image display section; and a control section for (i) causing data read out from the respective memories, to be written into the display areas to which the data corresponds, and (ii) causing the partial display area to move to an predetermined position within a display screen of the image display section when a predetermined time lapses.

In order to attain the object, a display method of the present invention includes the steps of: (i) displaying, on an image display section, data written into the image display section, the data being held thereon for a predetermined holding period; (ii) storing, in a full screen memory, data of at least one frame for a whole display area of the image display section; (iii) storing, in a partial screen memory, but not in the full screen memory, data of at least one frame for a partial display area; refreshing data written in the image display section; (iv) refreshing data written in the partial display area after the data written in the partial display area is held for a period shorter than the holding period of the image display section; (v) writing, data of at least one frame in the partial display area, the data being other than data of at least one frame to be written into the whole display area; and (vi) moving the partial display area to an predetermined position within a display screen of the image display section when an predetermined time lapses.

According to the above arrangement and the above method, by moving the partial display area to the predetermined position within the display screen of the image display section when the predetermined time lapses, it is possible to prevent sticking of the image on the image display section. Hereby, it is possible to prevent deterioration of display quality due to the sticking of the image on the image display section.

Moreover, stored in separate memories in a storage section are the data to be written in the whole display area of the image display section, and the data to be written in the partial display area. Therefore, it is possible to control, independently of each other, writing of the data into the display area of the image display section, and writing of the data into the partial display area. Because of this, it is possible to display an image that is desired by a user, on an area that is considered as a non-display area when the partial display is performed.

Further, in the case where the partial display area is moved for preventing the sticking of the image, in an area to which the partial display area is moved, data stored in a partial screen memory is read out and the data that has been written in the area is overwritten with the data thus read out.

In an area from which the partial display area has moved out, data stored in a whole screen memory is read out, and the data that has been written in the area is overwritten with the data thus read out. Therefore, the movement of the partial display area within the display screen of the image display section does not affect the image displayed on the area other than the partial display area.

Therefore, according to the above arrangement and the method, because the movement of the partial display area does not affect the image that is desired by the user and is displayed on the area other than the partial display area, the display quality for the case where the image display is performed on both the partial display area and the other display area, that is, the display quality of the image display section can be improved.

Furthermore, in case where the arrangement and the method are adopted as a display apparatus and a display method of a portable telephone for example, a still image is so displayed on the image display section that the data is held for a long period, and the partial display area is set, on which information (time, radio condition, battery condition, and the like) that need be updated sequentially.

In this case, power consumption is higher in the partial display area than in the area other than the partial display area, because it is necessary that the data be updated sequentially in the partial display area. However, in the area other than the partial display area, after the writing of the data, the data is held for a predetermined (holding) period longer than data update interval (that is, a refresh interval) of the partial display area, and then refreshed. Therefore, it is possible to reduce overall power consumption.

Therefore, according to the above arrangement and method, the power consumption is lowered compared with a case where the whole image display section is the partial display area, and as a result, the overall power consumption of the display apparatus and the display method are lowered.

For a fuller understanding of the nature and advantages of the invention, reference should be made to the ensuing detailed description taken in conjunction with the accompanying drawings.

BRIEF DESCRIPTION OF THE DRAWINGS

FIG. 9(*b*) is a display screen view showing another example of a scanning result of the display section.

DESCRIPTION OF THE EMBODIMENTS

First Embodiment

One embodiment of the present invention will be described below. Note that the present embodiment explains a case where the present invention is adopted in a liquid crystal display apparatus that is a hold-type display apparatus for performing image display, in which data is held on a display section for a predetermined period.

Figure 1:
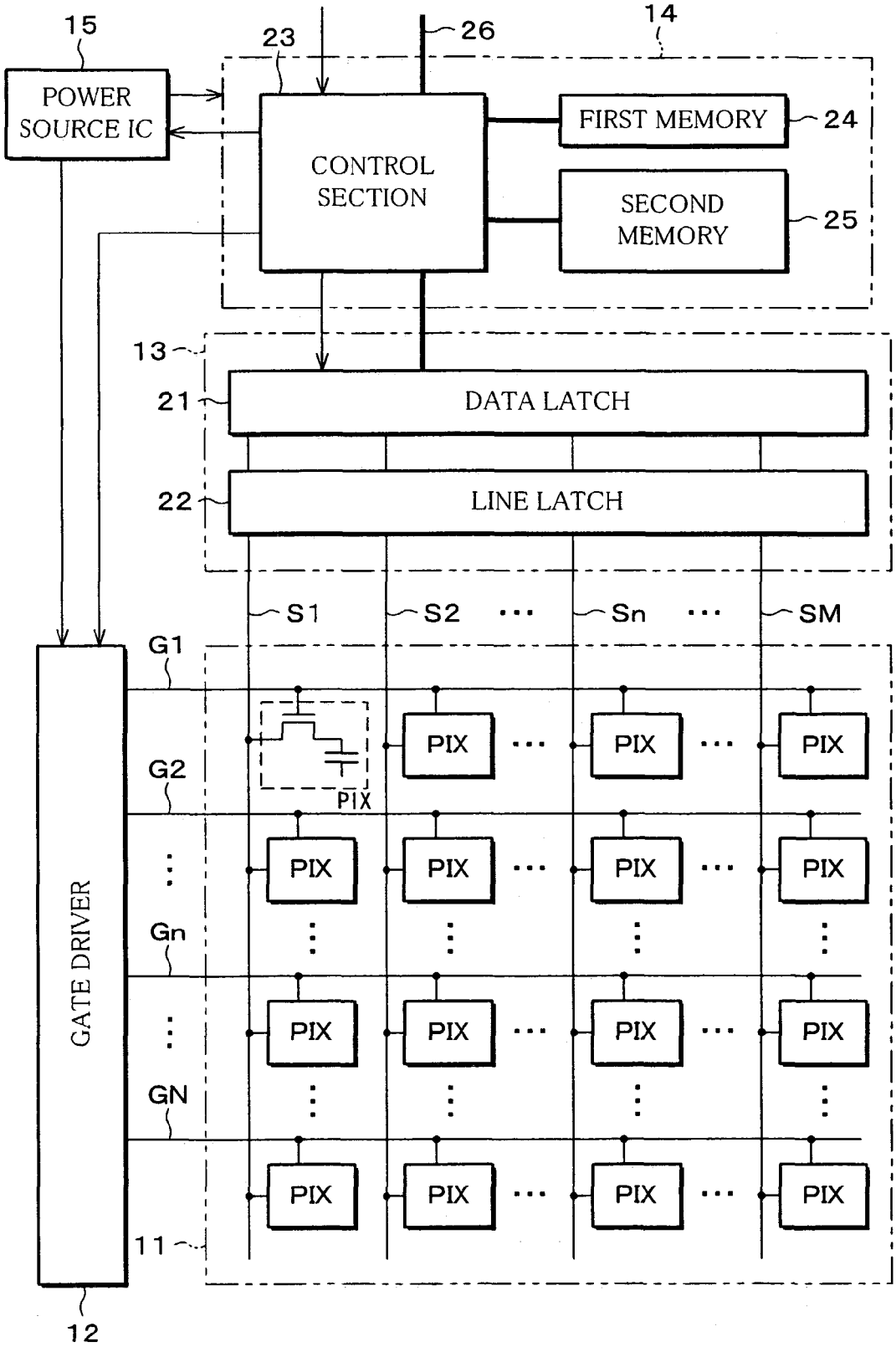
FIG. 1 is a block diagram illustrating an electric arrangement of a liquid crystal display apparatus as a display apparatus of one embodiment of the present invention.

The liquid crystal display apparatus of the present embodiment is, as shown in FIG. 1, provided with (i) a display section 11 including a liquid crystal panel, (ii) a gate driver 12 and a source driver 13 as driving circuits for driving the display section 11, (iii) a control IC (Integrated Circuit) 14 for sending (transmitting) an image signal and a control signal to the source driver 13, and (iv) a power source IC (Integrated Circuit) 15 for sending, to the gate driver 12 and the control IC 14, a control signal for driving.

In the display section 11, an N number of gate lines G1, G2, . . . , Gn, . . . , GN (hereinafter, the gate lines are referred to as gate lines G when collectively referred to), which are connected to the gate driver 12, and an M number of source lines S1, S2, . . . , Sn, . . . , SM (hereinafter, the source lines are referred to as source lines S when collectively referred to) are so arrayed as to cross each other perpendicularly. At each intersection of each line, a pixel PIX is connected. Each pixel PIX is connected with a liquid crystal capacitance, for example, via a TFT (Thin, Film Transistor) as a switching element. In short, the display section 11 is an active matrix-type liquid display panel in which the pixels PIX are positioned in matrix and are driven independently and respectively.

In the display section 11, similarly to a general active matrix-type liquid crystal display panel, display is performed by selecting and scanning the gate lines G line by line, and supplying a data signal from the source lines S to each pixel PIX connected to the gate lines G thus selected .

Moreover, the display section 11 is a hold-type display section that refreshes data written in the pixels PIX after holding the data for a predetermined period. On the display section 11, provided is a partial display area in which data is refreshed (updated) as needed. The partial display area is driven independently of other display areas on the display section. Display operation of the display section 11 will be described in detail later.

The source driver 13 is provided with (i) a data latch 21 for temporarily storing the image signal transmitted from the control IC 14, and (ii) a line latch 22 for storing the image signal for one line, which is transmitted from the data latch 21. The source driver 13 sends the image signal to the source lines S in a timing based on the control signal transmitted from the control IC 14.

The control IC 14 is provided with (i) a control section 23 for controlling timings for the transmission of the image signal and the control signal to be supplied to the source driver 13, (ii) a first memory 24 as a partial screen memory for storing therein data of at least one frame of the partial display area of the display section 11, (iii) a second memory 25 as a full screen memory for storing therein data of at least one frame of the whole display area of the display section 11. The data for at least one frame is preferably of one frame, but may be of two or three frames.

The data to be stored in the first memory 24 and the second memory 25 is supplied via a bus 26 connected to an external image signal source (not shown). The control section 23 controls the storing and reading of the data into/out of the first memory 24 and the second memory 25.

Moreover, the control section 23 also functions as an image-display-section refreshing section and a partial-display-area refreshing section, which will be described later. As the image-display-section refreshing section and the partial-display-area refreshing section, the control section 23 transmits, in accordance with a control signal that is externally inputted, a control signal for controlling the driving of the gate driver 12 and the power source IC 15.

In accordance with the control signal transmitted from the control section 23, the power source IC 15 transmits the control signal for driving the pixel PIX to the gate driver 12 and the control IC 14.

An example of operation of the display section 11 is explained below, referring to FIG. 2. Note that the following explains a case where the liquid crystal display apparatus having the above arrangement is adopted in a portable telephone.

As described above, the display section 11 is so arranged that the partial display area can be driven independently of the display area of the image display section. In FIG. 2, the partial display area is referred to as an A area, while the area other than the partial display area is referred to as a B area. Note that the B area is the whole display area of the display section 11, and the A area is driven on part of the. B area. However, for easy explanation, it is regarded here that the B area is the display area other than the A area.

Moreover, the display section 11 is, as described above, provided with the N number of gate lines G. Thus, the display section 11 is capable of displaying image data of N lines. In the example shown in FIG. 2, the B area is the whole display area between the first gate line G1 to the gate line GN. Meanwhile, the A area is the area between the start line position and the end line position where the start line position is the gate line G1 and the end line position is the nth gate line Gn.

The A area is a screen area in which the display area is refreshed. Thus, display data is overwritten as needed in the A area. On the other hand, the B area is a screen area in which the display data is refreshed at an interval longer than a refresh interval of the display data of the A area. Therefore, the display data written in the B area is held for a longer time than the display data of the A area.

In the present embodiment describing the display apparatus of the portable telephone as an example, the A area of the display section 11 is a display area (hereinafter, a partial display area) for display data that need be overwritten as need, such as a radio wave condition, a battery condition, time, and the like. Meanwhile, the B area is a display area (hereinafter a still image display area) on which during the waiting period a user can display an image that he desires.

In short, the A area and the B area have different display modes. Specifically, the A area is in a general active display mode, meanwhile the B area is in a hold display mode, in which written data is held at a picture element section (Pixel PIX) as long as possible, by utilizing characteristics of the hold-type display apparatus. Such a display method in which the partial driving method is adopted and the still image display area other than the partial display area is in the hold display mode is referred to as an active partial scan method.

The display data of at least one frame for the A area is stored in the first memory 24. The display data for the B area is stored in the second memory 25 and, is read out as needed and transmitted to the display section 11 in a predetermined timing.

The driving of A area and the B area on the display section 11 can be controlled independently of each other, because of the provision of the first memory 24 and the second memory 25 for respectively storing the display data of at least one frame for the A area and that for the B area separately.

Figure 2:
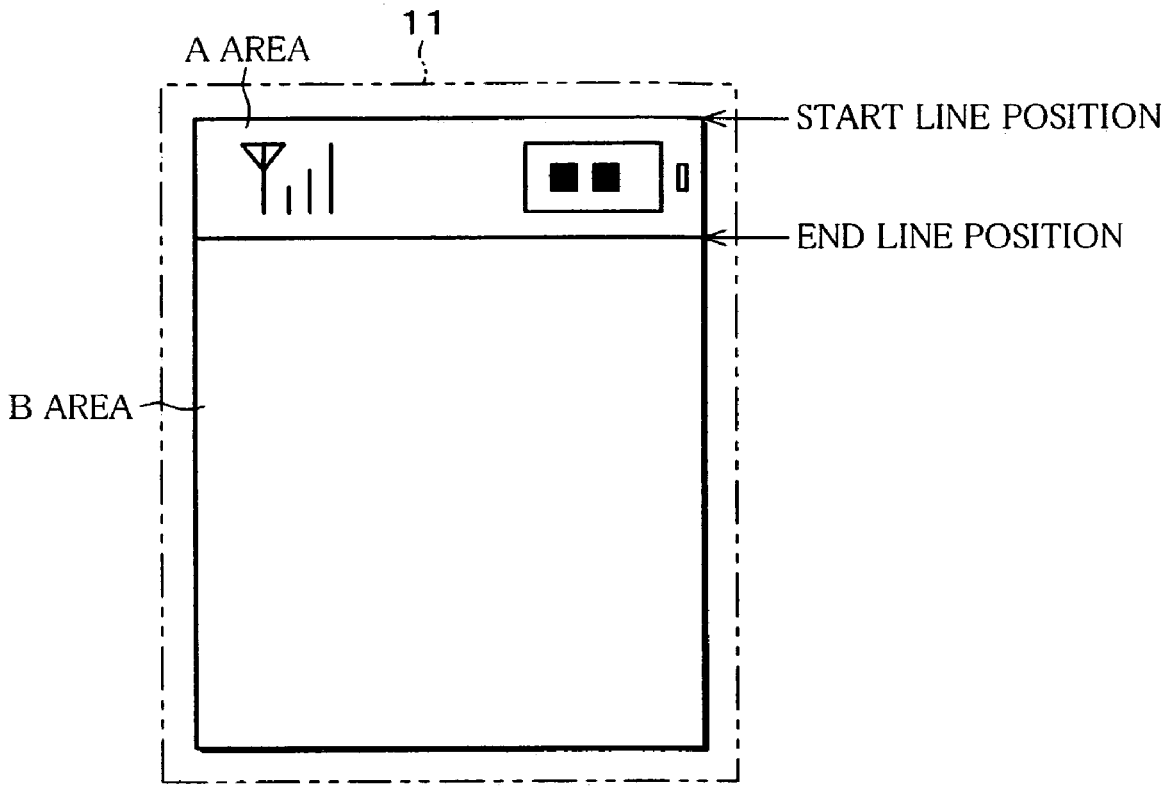
FIG. 2 is a display screen view showing a display example on a display section of the liquid crystal display apparatus.

In the example illustrated in FIG. 2, read out from the first memory 24 is data of one frame between the gate line GI and the gate line Gn. Data read out from the second memory 25 is not data of one frame for the whole display area between the gate line G1 and the gate line GN, but data for an area between the gate line Gn+1 and the gate line GN, the area corresponding to the B area.

The reading of the display data from the first memory 24 and the second memory 25 is controlled by the control section 23 inside the control IC 14. The control of the reading-out of the display data will be described below.

In the active partial scan method, as shown in FIG. 2, the data such as radio wave condition, the battery condition, time and the like is displayed on the A area. In case where a waiting screen composed mainly of a still image is displayed on the B area, it is possible to reduce the power consumption of the whole display section 11, by setting so that the A area has such a display area whose size is large enough but as small as possible, for example, large enough to see and check the display of the antenna, the radio wave condition, or the like, and that the B area is larger than the A area, it is possible to reduce the power consumption of the overall display section 11.

Note that the power consumption can be reduced compared with a case where the whole display area is the A area, as long as the A area exists in at least part of the display screen of the display section 11. Thus, the ratio of the display areas of the A area and B area is not particularly limited.

In case where as described above the ratio of the A area is smaller than the B area in the display section 11, as a specific example of use, it is conceivable that information such as news automatically delivered is displayed by scrolling, and a still image selected by a user is displayed on the B area. Moreover, it may be also conceivable that by changing the ratio between the A area and the B area in the display section 11, a moving image by a TV telephone function is displayed on the A area, while a fixed pattern is displayed on the B area, so as to avoid extreme increase in the power consumption necessary for the display.

Explained below is a flow of the display operation of the display section 11, referring to a flow chart shown in FIG. 3.

Figure 3:
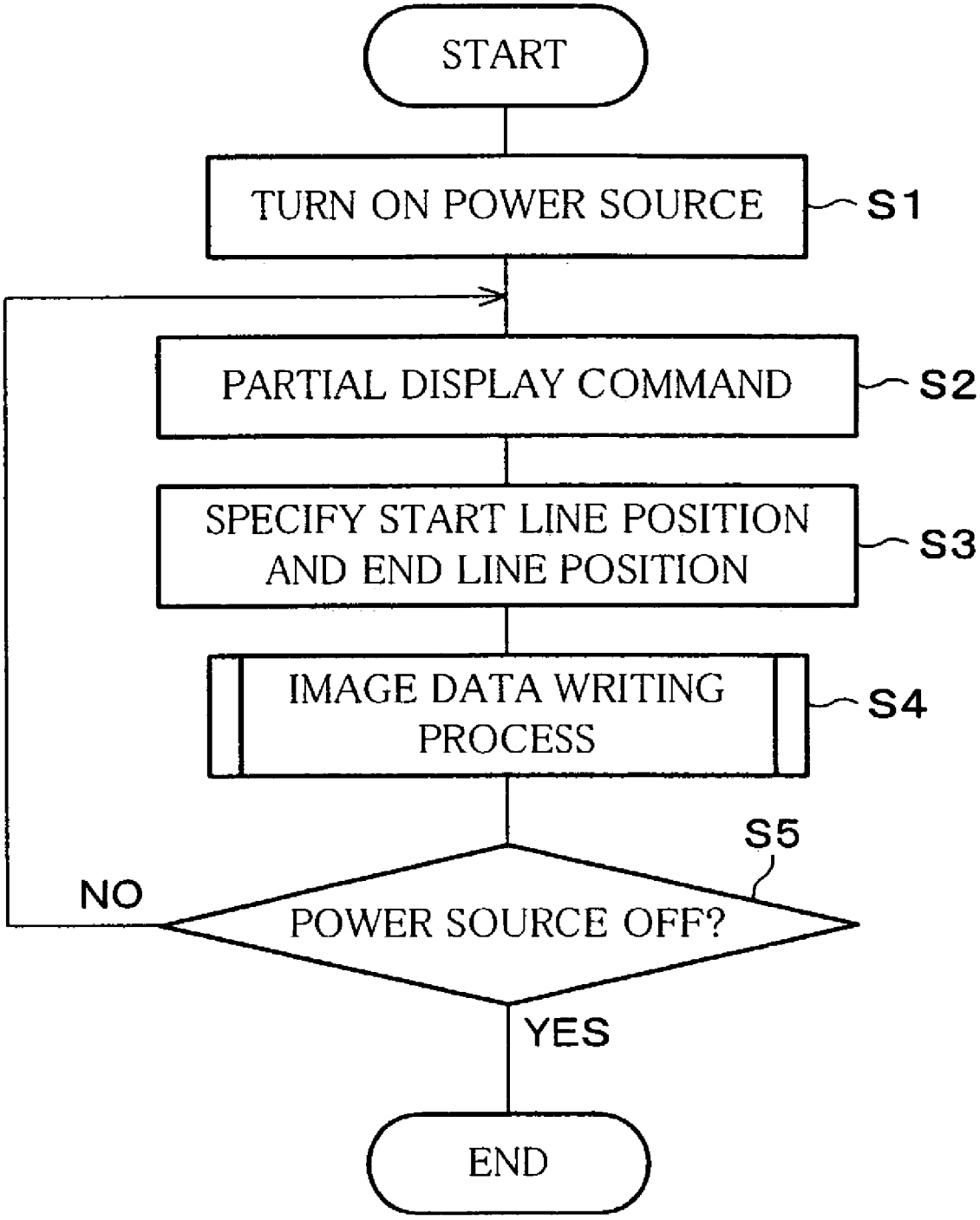
FIG. 3 is a flow chart illustrating display operation of the liquid crystal display apparatus.

Firstly, as shown in FIG. 3, at step S1, when the liquid crystal display apparatus is turned ON, a partial display command is carried out (step S2). Here, the partial command is, as shown in FIG. 2, a command for controlling so as to divide the display screen of the display area 11 into the A area and the B area which are in the different display modes. The partial command is included in the control signal from outside of the liquid crystal display apparatus, and is carried out by the control IC 14 shown in FIG. 1.

After the partial display command is carried out by the control IC 14, a start line position from which the display area of the A area starts, and an end line position at which the A area ends are specified (step S3). Specifically, part of the gate lines G of the display section 11 is specified. When the display area for the A area is specified as such, the display area of the B area is sequentially (automatically) specified because the display area of the B area is the area except the A area.

Next, writing of the image data into the display section 11 is carried out (step S4). This process is carried out until power of the liquid crystal display apparatus is turned OFF (step S5).

At step S4, writing of the image data into the A area and writing of the image data into the B area are carried out independently of each other.

Figure 4:
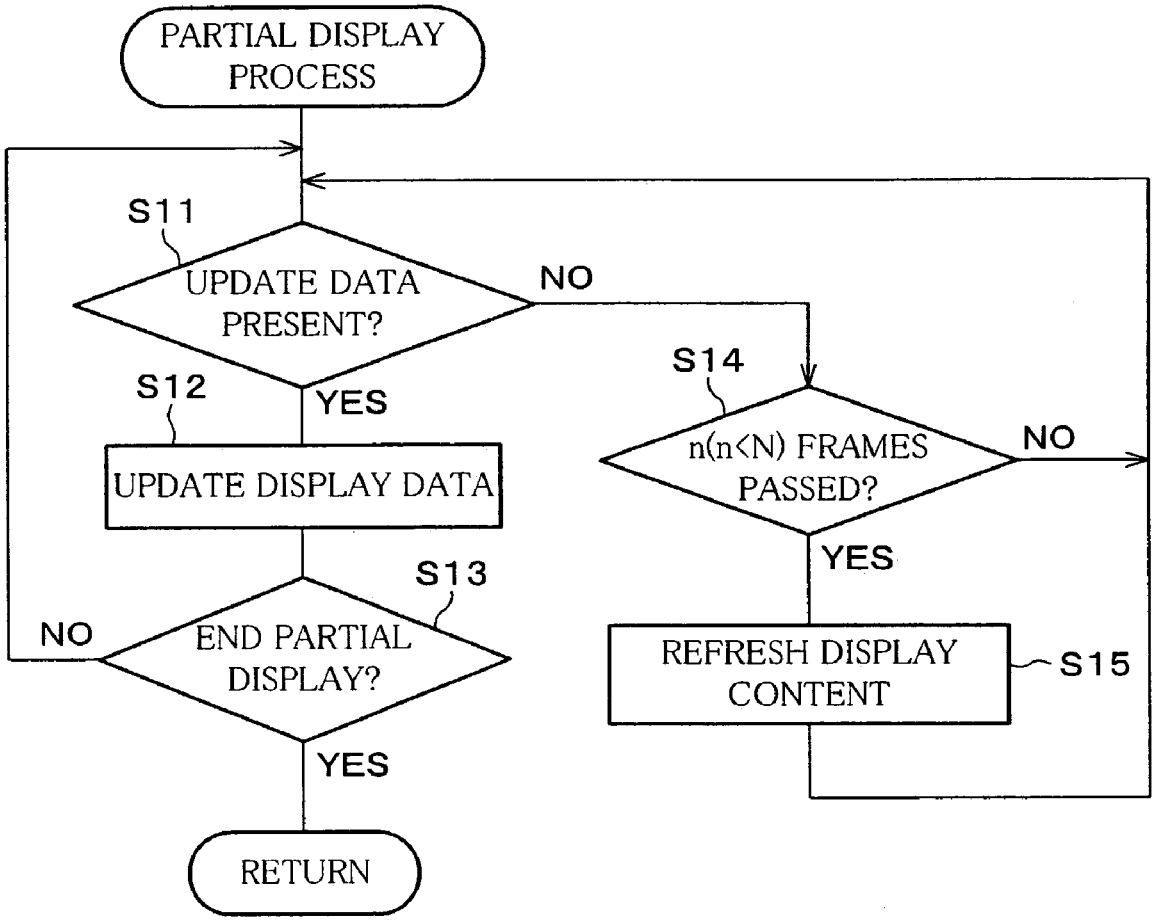
FIG. 4 is a flow chart illustrating a subroutines of performing a partial display in the display operation.

To begin with, partial display process of the A area A is described below, referring to a flow chart shown in FIG. 4.

Firstly, the control IC 14 judges whether update data is present or absent (Step S1 ). Here, update data is data regarding the radio wave condition or battery condition shown in the A area.

At step 11, if it is judged that the update data is present, the display data of the A area is updated (Step S12).

Next, it is judged whether or not a command of ending partial display is carried out (step S13). Here, if the command of ending the partial display is carried out, the display operation goes to step S5 shown in FIG. 3. If the command of ending the partial display is not carried out, the display operation goes to step S11 again, and it is judged whether the update data is present or absent.

Moreover, at step S11, if it is judged that the update data is absent, it is judged whether or not n (n<N) frames have passed (step 14), where n is a number of frames that is set in advance, and N is a number of frames before refreshing the data for the still image display process on the B area.

At step S14, if the n frames have passed, the display content of the A area is refreshed by the control section 23 (step S15). Here, the word "refresh(ing)" has a meaning to refresh the content displayed on the A area, but not to update the content.

On the other hand, as step 514, if the n frames have not passed, the display operation goes to step S11 again, and it is judged whether the update date is present or absent.

Figure 5:
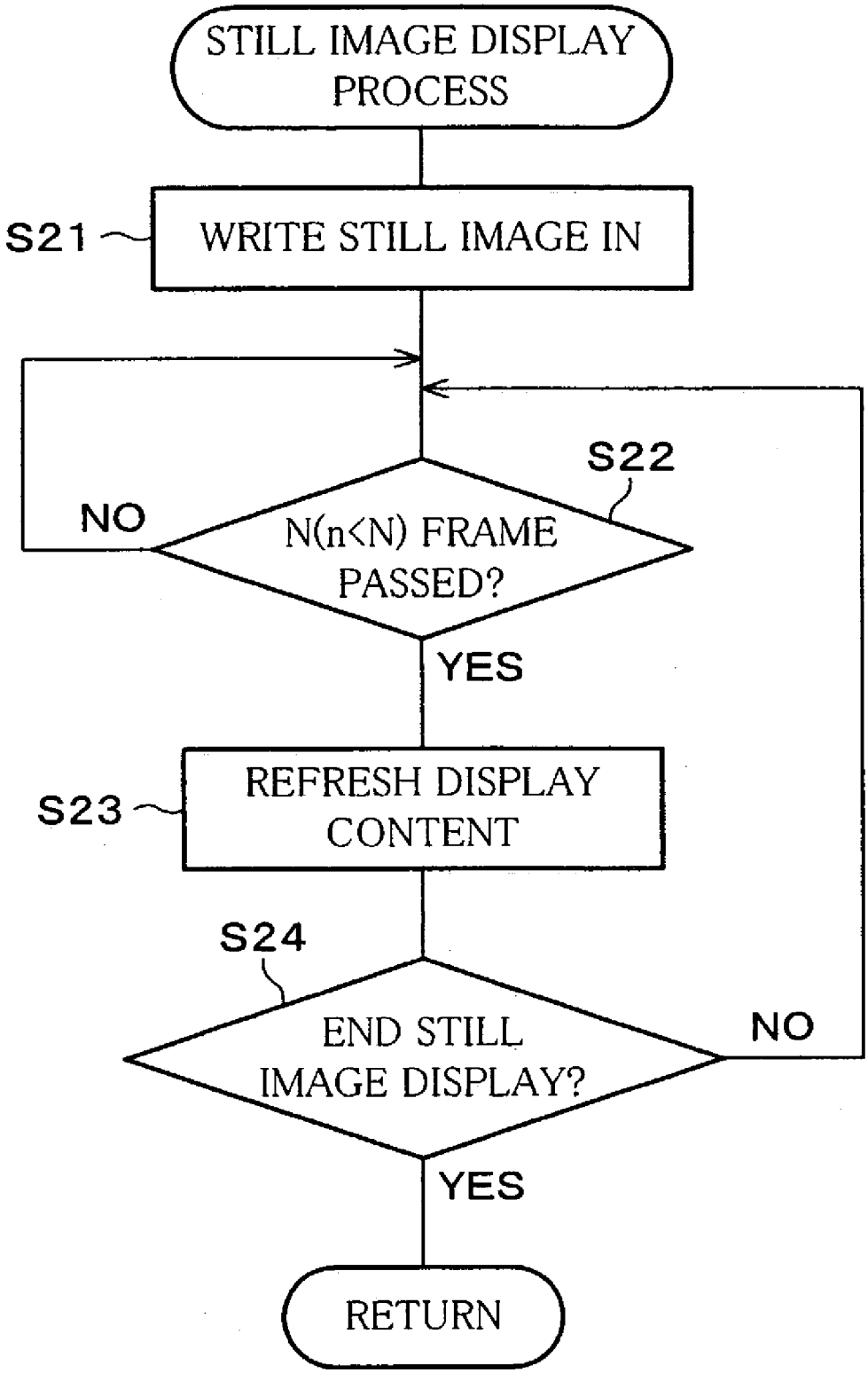
FIG. 5 is a flow chart illustrating a subroutine of performing still image display in the display operation.

Next, the still image display process for the B area is described blow, referring to a flow chart shown in FIG. 5.

To begin with, the still image is written batchwise into the B area (step S21). On the B area, the display data that has been written is held for a certain period (of N frames). This period is decided depending on display data holding characteristics of the liquid crystal display panel of the display section 11. Here, the writing of the data into the B area is carried out with respect to the area except the area into which the writing for the A area is carried out.

Next, it is judged whether the N frames have passed or not (step S22). Here, on the B area, the display data for the still image is held until the N frames have passed.

At step S22, if it is judged that the N frames have passed, the data for display content of the B area is refreshed by the control section 23 (step S23). Here, the refreshing is for preventing deterioration of the display content of the B area.

Next, it is judged whether the command of ending the still image display is carried out or not (step S24). Here, if the command of ending the still image display is carried out, the display operation goes to step S5 shown in FIG. 3. If the command of ending the still image display is not carried out, the display operation goes to step S22 again so as to judge whether or not the N frames have passed.

As described above, on the display section 11, it is possible to display an image on both the A area and the B area, the A area being the partial display area in which the data is overwritten as needed, and the B area being the hold-type display area in which the written display data is held for a predetermined period, and then refreshed. Thus, it is possible to realize full screen display while the power consumption in performing the partial display is maintained.

Figure 6:
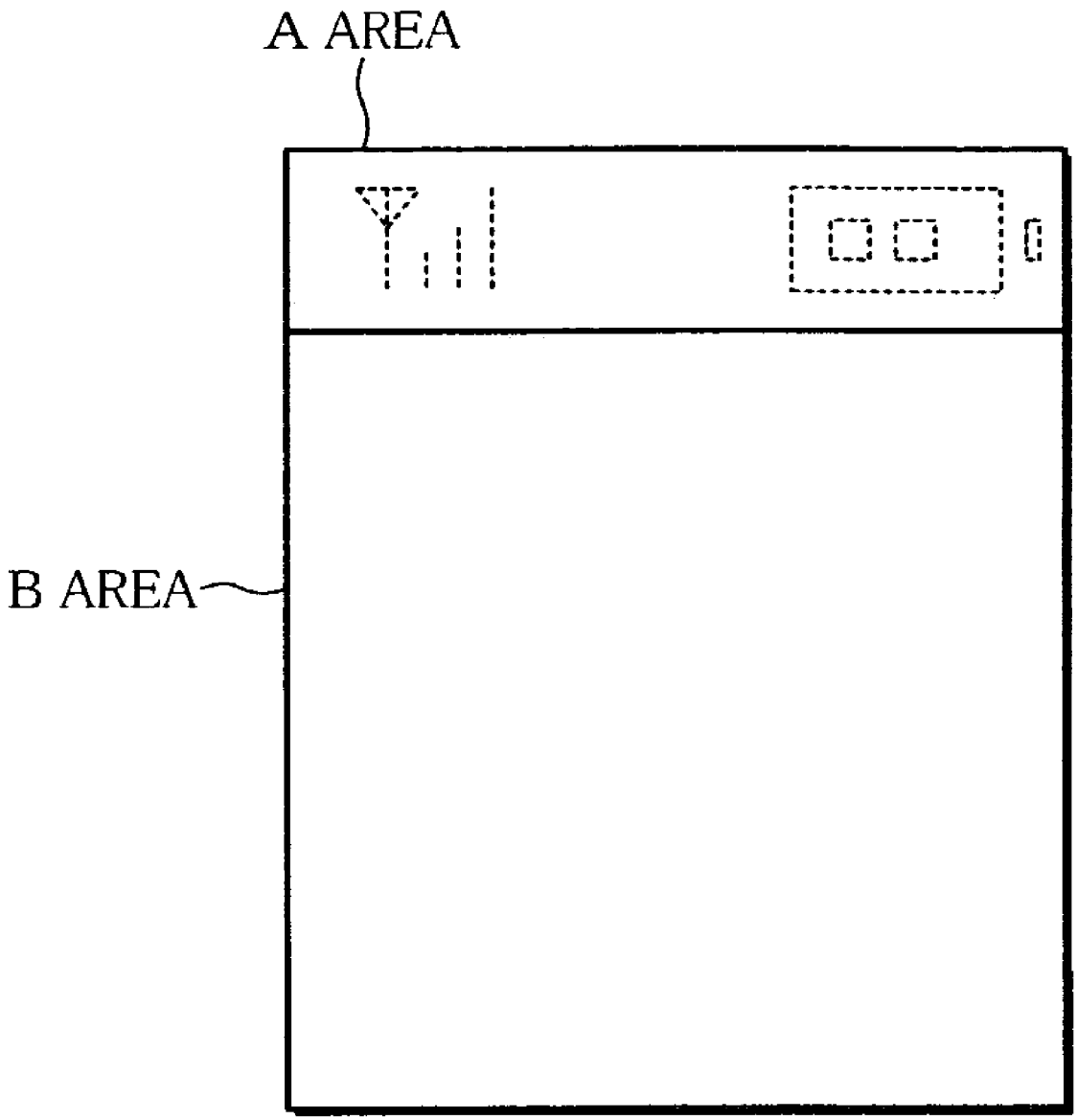
FIG. 6 is a display screen view showing an example of sticking of an image caused in case where a general partial display is carried out.

In case where the display is kept only in a certain position on the display screen, as shown in FIG. 6, usually, sticking of the screen (image) is caused, thereby deteriorating long-term reliability of the display section 11.

Figure 7:
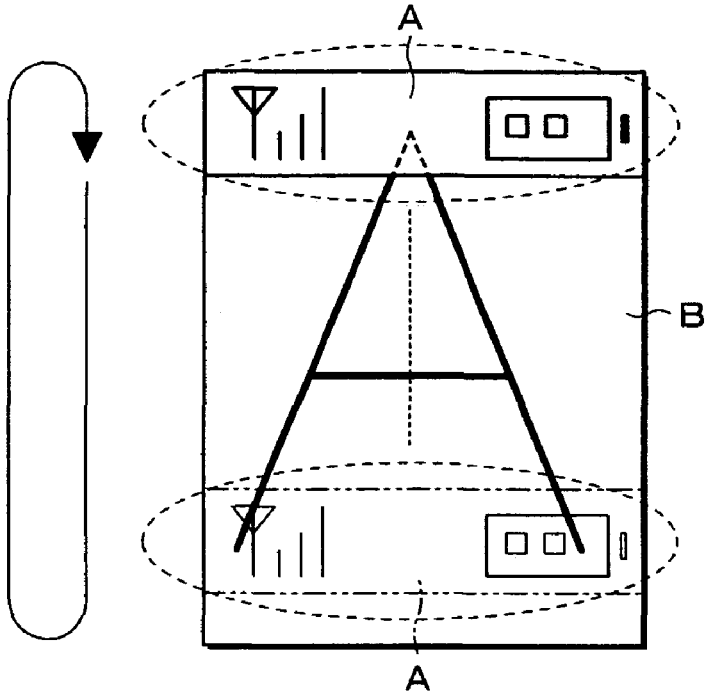
FIG. 7 is a display screen view showing an example of scroll display process for preventing sticking.

Thus, for preventing the sticking of image, it is conceivable that the A area is moved to a predetermined position on the B area in the display section 11. For example, as shown in FIG. 7, the A area is scrolled line by line in the arrow direction on the display screen of the display section 11, that is, from an upper part to a lower part, or from the lower part to the upper part (up and down). Further it is also conceivable that the A area is randomly moved on the display screen of the display section 11 (hereinafter, this kind of display is referred to as random display), as shown in FIG. 8.

Figure 8:
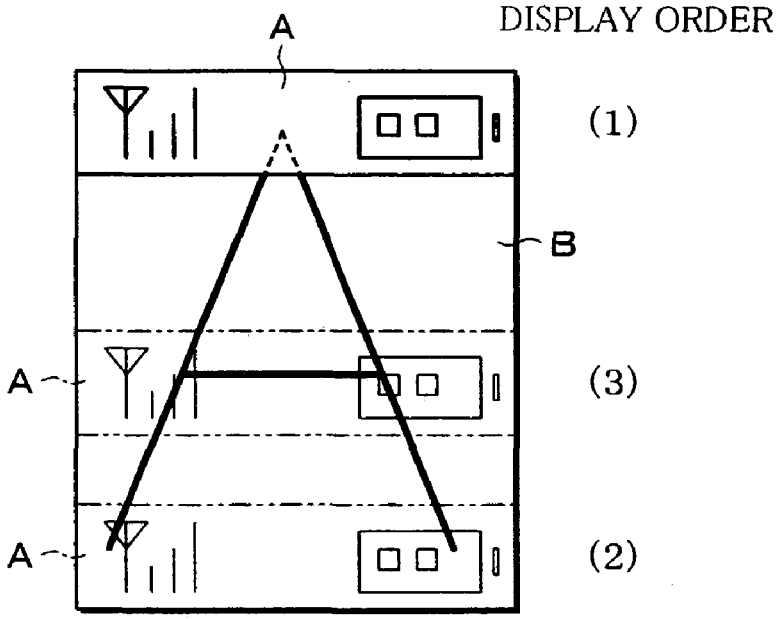
FIG. 8 is a display screen view showing an example of random display process for preventing sticking.

In the case of the random display, as shown in FIG. 8, in several frames from a first frame, the A area is displayed on the position labeled with (1) (position (1)). In following several frames, the A area is moved from the position (1) to the position (2) (the position labeled with (2)) that is located on a bottom of the display screen, and is displayed on the position (2). Then, in further following frames, the A area is moved from the position (2) to the position (3) (the position labeled with (3)) that is located substantially in a middle of the display screen, and is displayed at the position (3). In further later frames, the A area is moved at a predetermined frame interval similarly.

In the method shown in FIG. 7, in which the A area is scrolled, the display is so controlled that a start position of the display of the A area, and an end position of the display of the A area are shifted line by line. In the random display, shown in FIG. 8, in which the A area is moved randomly, a start position of the display of the A area and an end position of the display of the A area are shifted randomly. In both the methods, the interval of the movement of the A area is long enough to allow a user to see and check (cognize) the display content of the A area.

Figure 9:
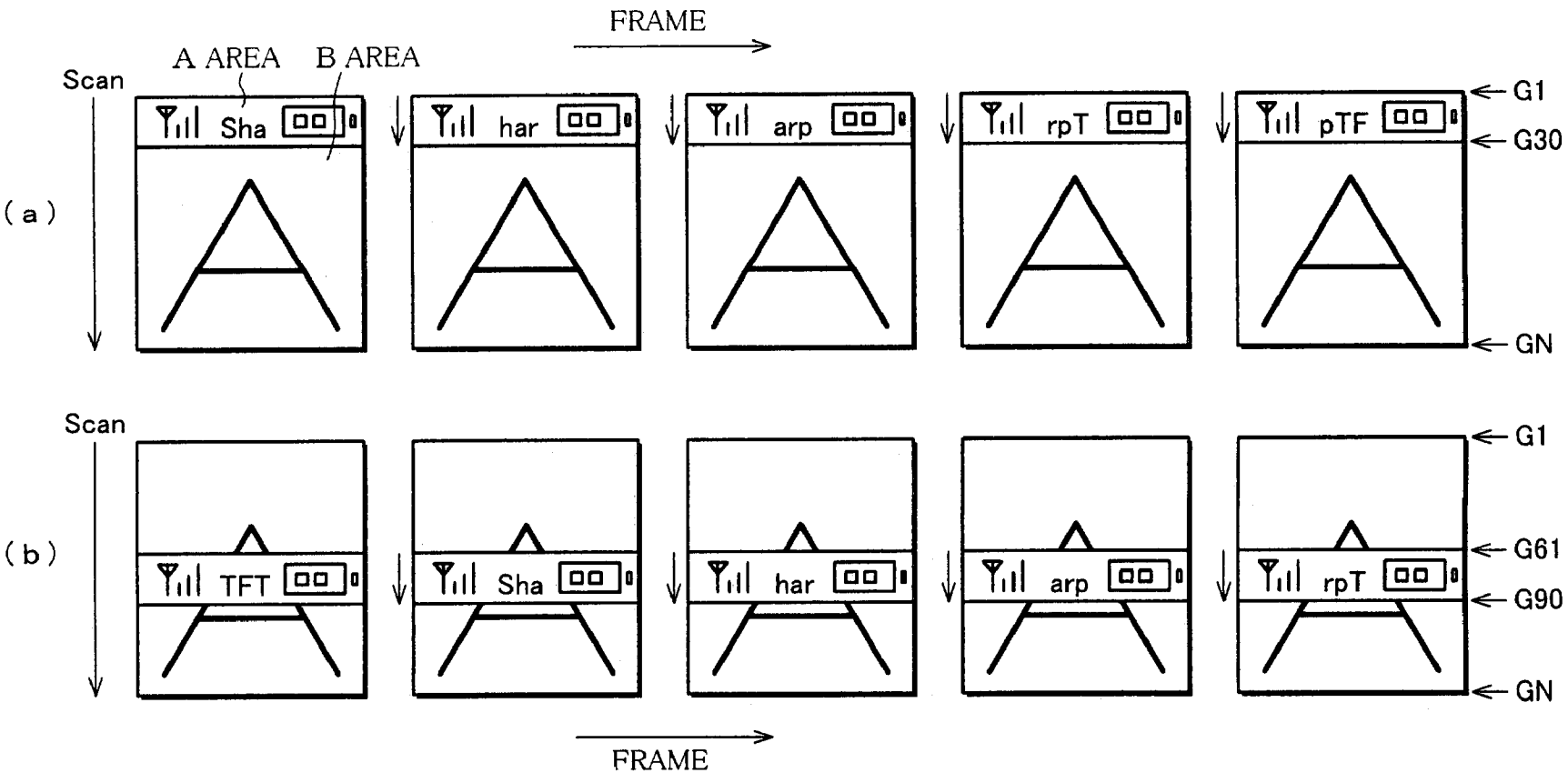
FIG. 9(*a*) is a display screen view showing an example of a scanning result of the display section.

In case of the random display in which the A area is moved randomly, for example, the A area is displayed as shown in FIGS. 9(*a*) and 9(*b*). Here, in FIG. 9(*a*), the A area is positioned as shown in FIG. 2, and display conditions of 5 frames, for example, is illustrated. In FIG. 9(*b*), the A area is moved to a substantial middle of the B area, and display condition of 5 frames, for example, is illustrated at the substantial middle. In short, the interval of the movement of the A area from the condition shown in FIG. 9(*a*) to condition shown in FIG. 9(*b*) is of 5 frames.

With those arrangements, in which the A area is not displayed fixedly but is moved on the B area, it is possible to prevent the sticking of the screen (image). This prevents deterioration in display quality due to screen sticking on the image display section.

Moreover, the display data of one frame for the A area and the display data of one frame for the B area, which are stored in the separate memories (the first memory 24 and the second memory 25), are read out independently of each other, and written into the A area and B area independently of each other.

Therefore, it is possible to perform, independently of each other, the writing of the data into the B area that is the display. area of the image display section, and the writing of the data into the A area that is the partial display area.

Moreover, in the area to which the A area is to be moved, the data stored in the first memory 24 is read out, and the data that has been written thereon is overwritten with the data thus read out from the first memory 24. In the area from which the A area has been moved out, the data stored in the second memory 25 is read out, and the data that has been written thereon is overwritten with the data thus read out from the second memory 25.

The movement of the A area within the display screen of the image display section does not affect the image displayed on the area (B area) other than the A area, because, as described above, the data of at least one frame for the whole display area of the image display section is stored in the second memory 25, and the data of at least one frame for the A area is stored in the first memory 24, but not the second memory 25.

Therefore, the A area that is the partial display area and the B area that is the display area other than the A area can coexist. As a result, the display quality of the display section 11 can be improved.

The writing of the display data into the A area and B area of the display area 11, and the refreshing of the display data are controlled by the control section 23 in the control IC 14.

The display control of the A area and the B area in the display section 11 is described below, referring to the waveform charts in FIGS. 10 and 11.

The control section 23 controls the reading-out of the display data from the first memory 24 and the second memory 25, in accordance with a memory reading signal and a memory selecting signal. The memory reading signal indicates whether the reading-out of the display data from the first memory 24 and the second memory 25 is to be performed or not. The memory selecting signal is for selecting from which one of the first memory 24 and the second memory 25 the display data is to be read out.

For example, when the memory reading signal is of high level, the control section 23 reads out the display data stored in the first memory 24 and/or the second memory 25. Moreover, when the memory selecting signal is of high level, the reading-out of the display data stored in the first memory 24 is allowed. When the memory selecting signal is of low level, the reading-out of the display data stored in the second memory 25 is allowed. In short, when the memory reading signal is of high level and the memory selecting signal is of high level, the display data stored in the first memory 24 is read out. When the memory reading signal is of high level and the memory selecting signal is of low level, the display data stored in the second memory 25 is read out.

Figure 10:
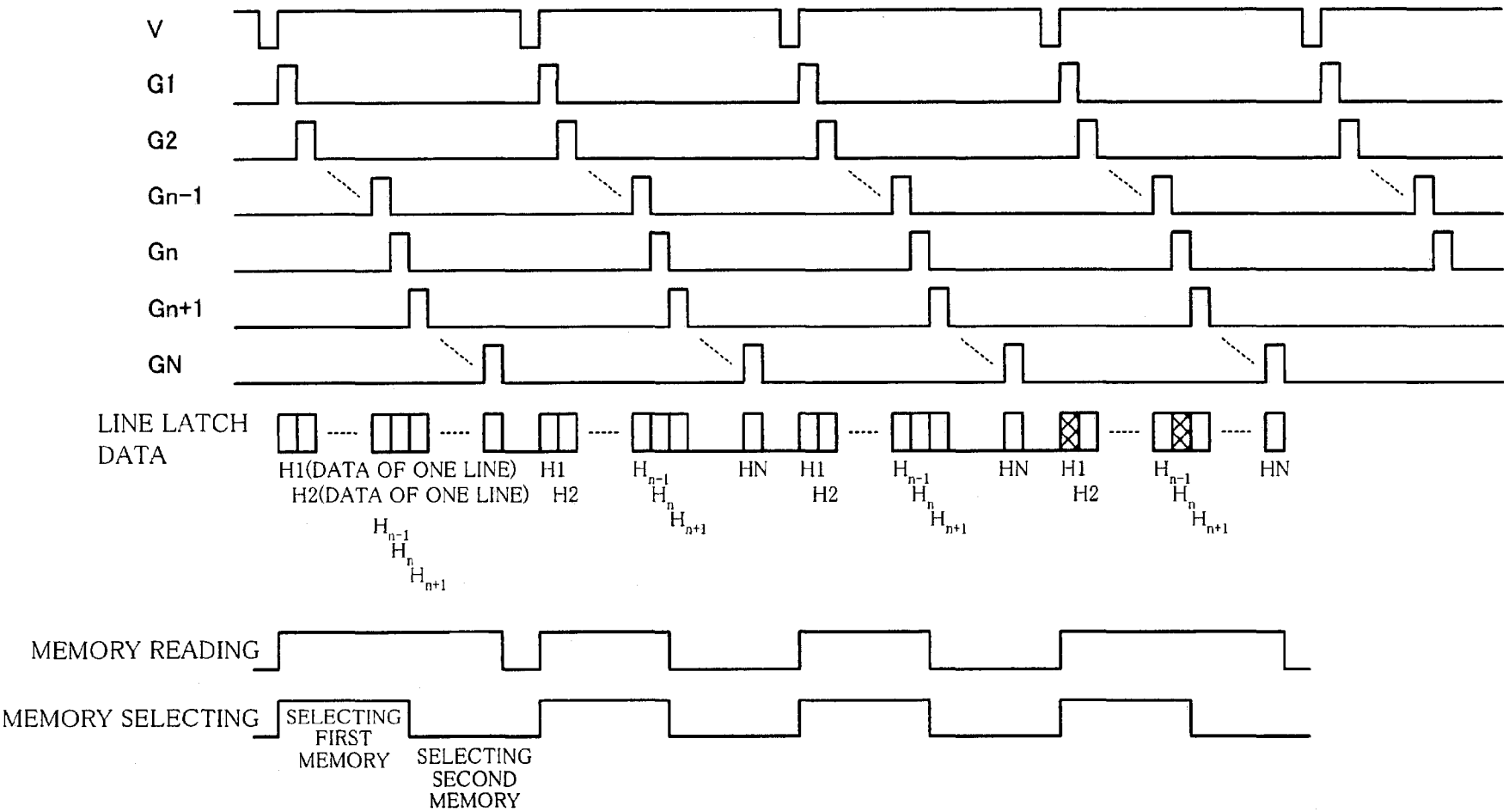
FIG. 10 is a chart illustrating waveforms showing timing of memory read-out by the liquid crystal display apparatus.

In the example shown in FIG. 10, in the first frame (gate lines G1 to GN), the memory reading signal is of high level, so that the memory selecting signal of high level and the memory selecting signal of low level are contained. Thus, the display data stored both in the first memory 24 and in the second memory 25 is read out. In a period between the second frame and the third frame, the display data stored in the first memory 24 is read out because the memory reading signal is of high level when the memory selecting signal is of high level. Further, in the next fourth frame, as in the first frame, the memory reading signal is of high level, so that the memory selecting signal of high level and the memory selecting signal of low level are contained. Thus, the display data stored in the first memory 24 and the display data stored in the second memory 25 are read out.

In short, in the example shown in FIG. 10, the display data stored in the first memory 24 is read out per frame, meanwhile the display data stored in the second memory 25 is read out every three frames. In this example, in the B area of the display section 11, the written display data is held for three frames.

As described above, the A area and the B area are not overwritten similarly, that is an overwriting period (an interval between overwriting process and next overwriting process) of the B area that is mainly for displaying the still image is longer than an overwriting period of the A area in the display section 11. With this arrangement, it is possible to reduce the power consumption of the display section 11. Note that, a holding period of the display data may not be 3 frames, as long as the deterioration of the display image is below tolerance level. The longer the holding period of the display data, the lower power consumption.

Moreover, in the example shown in FIG. 10, so as to correspond to the display area of the A area and that of B area in the display section 11 (that is, corresponding to where the A area and the B area are displayed on the display section 11), it is set that the gate lines G1 to Gn are selected in a period in which the memory selecting signal is of high level, meanwhile, the gate lines Gn+1 to GN are selected in a period in which the memory selecting signal is of low level. In short, in the display screen of the display section 11, if the display areas of the A area and B area are changed, the period in which the memory selecting signal is of high level, and the period in which the memory selecting signal is of low level, are changed in accordance with the change in the display areas.

For example, where, as shown in FIG. 9(*a*), the start line position of the display area of the A area is on the gate line G1, and the end line position thereof is on the gate line G30, the start line position of the display area of the B area is on the gate line G31, and the end line position thereof is on the gate line GN. In this case, the period in which the memory selecting signal is of high level is from a selection period of the gate line G1 to a selection period of the gate line G30. In the period in which the memory selecting signal is of low level, is from the selection period of the gate line G31, beyond a selection period of the gate line GN, to an end of the current frame.

Moreover, where, as shown in FIG. 9(*b*), the start line position of the display area of the A area is on the gate line G61, and the end line position thereof is on the gate line G90, the display area of the B area includes (i) the area between the start line position on the gate line G1, and the end line position on the gate line position G60, and (ii) the area between the start line position on the gate line G91 and the end line position on the gate line GN. In this case, the period in which the memory selecting signal is of high level is between a selection period of the gate line G61 and a selection period of the gate line G90. Meanwhile, the period in which the memory selecting signal is of low level is a sum of (i) a period between the selection period of the gate line G1 and a selection period of the gate line G60, and (ii) a period between a selection period of the gate line G91, beyond the selection period of the gate line GN, to the end of the current frame.

As described above, in accordance with where the A area and B area are set, changed are the period in which the memory selecting signal is of high level and the period in which the memory selecting signal is of low level. By doing this, the display data from the first memory 24 is written into the A area at any time, and the display data from the second memory 25 is written into the B area at any time. This makes it possible to surely drive the A area and the B area independently of each other.

Incidentally, in the display screen of the display section 11, a frequency (writing frequency) of the writing the display data of the A area and that of the B area are different. The writing frequency of the B area is much less than the writing frequency of the A area. In such case, for example, if the B area has a display color that is identical to a background color of the A area, a user can recognize that a color difference between the A area and the B area is caused, as time lapses, due to the difference in the writing frequencies of the display data. In such case, a border between the A area and the B area becomes recognizable, thereby deterioration the display quality of the display screen.

Therefore, in the following embodiment, the human vision characteristics is utilized to write a white line on the border between the A area and the B area, so as to render the color difference between the A area and the B area apparently less visible. By writing a color line on the border as such, it becomes unrecognizable that the prevention of the deterioration in the display quality is being performed, so as to render the color of the A area and the color of the B area look almost identical. Because of this, the border between the A area and the B area becomes less visible. Hereby, it is possible to prevent the deterioration in the display quality.

Second Embodiment

Another embodiment of the present invention is described below. Note that the present embodiment describes a case where the present invention is adopted in a liquid crystal display apparatus which is a hold-type display apparatus, as the first embodiment. Moreover, sections having the same functions as in the first embodiment are labeled in the same fashion, and their explanation is omitted here.

Figure 11:
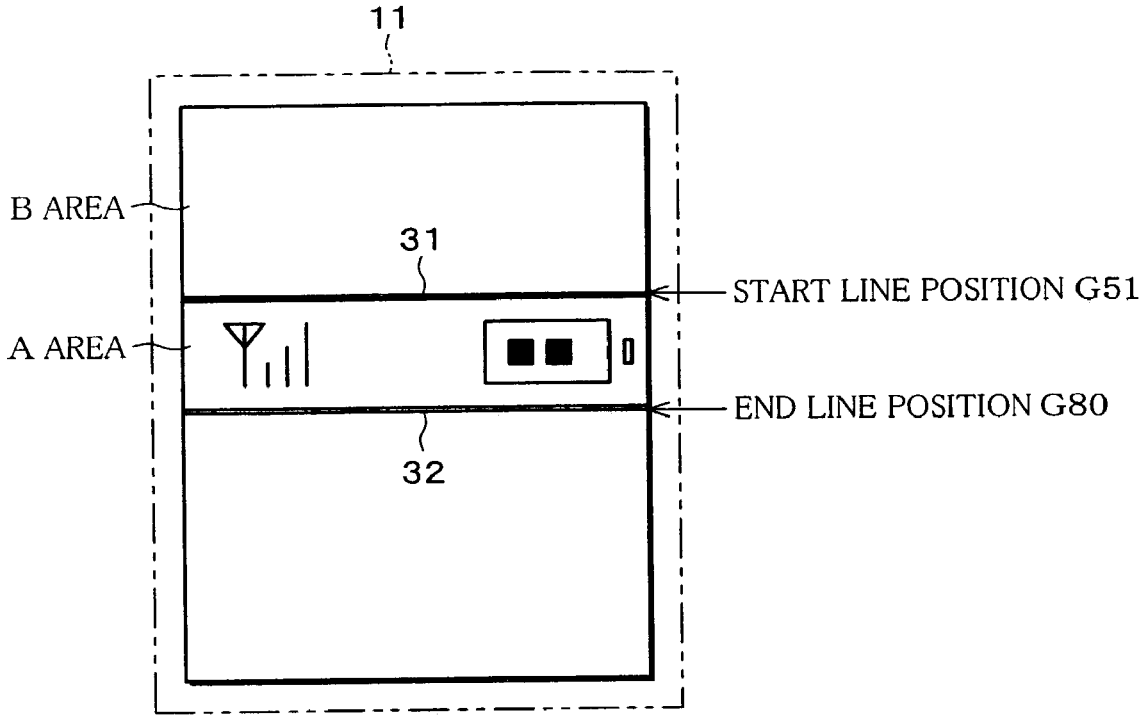
FIG. 11 is a display screen view showing an example of display performed by a display section of a liquid crystal display apparatus of another embodiment of the present invention.

The liquid crystal display apparatus of the present embodiment is provided with a display section 11 shown in FIG. 11.

In the display section 11, an A area that is a partial display section is positioned substantially at a middle of the display screen, and border lines 31 and 32 are border lines between the A area and a B area that is a still image display section. The border line 31 indicates a start line position, whereas the border line 32 indicates an end line position. The border lines 31 and 32 are displayed as white lines or black lines.

For example, where the start line position of the A area is on a gate line G51 and the end line position of the A area is on a gate line G80, line latch data for the gate line G51 and line latch data for the gate line G80 are display data for white or that for black. Moreover, the border lines 31 and 32 may include one or several lines on at least one side of the line selected.

Figure 12:
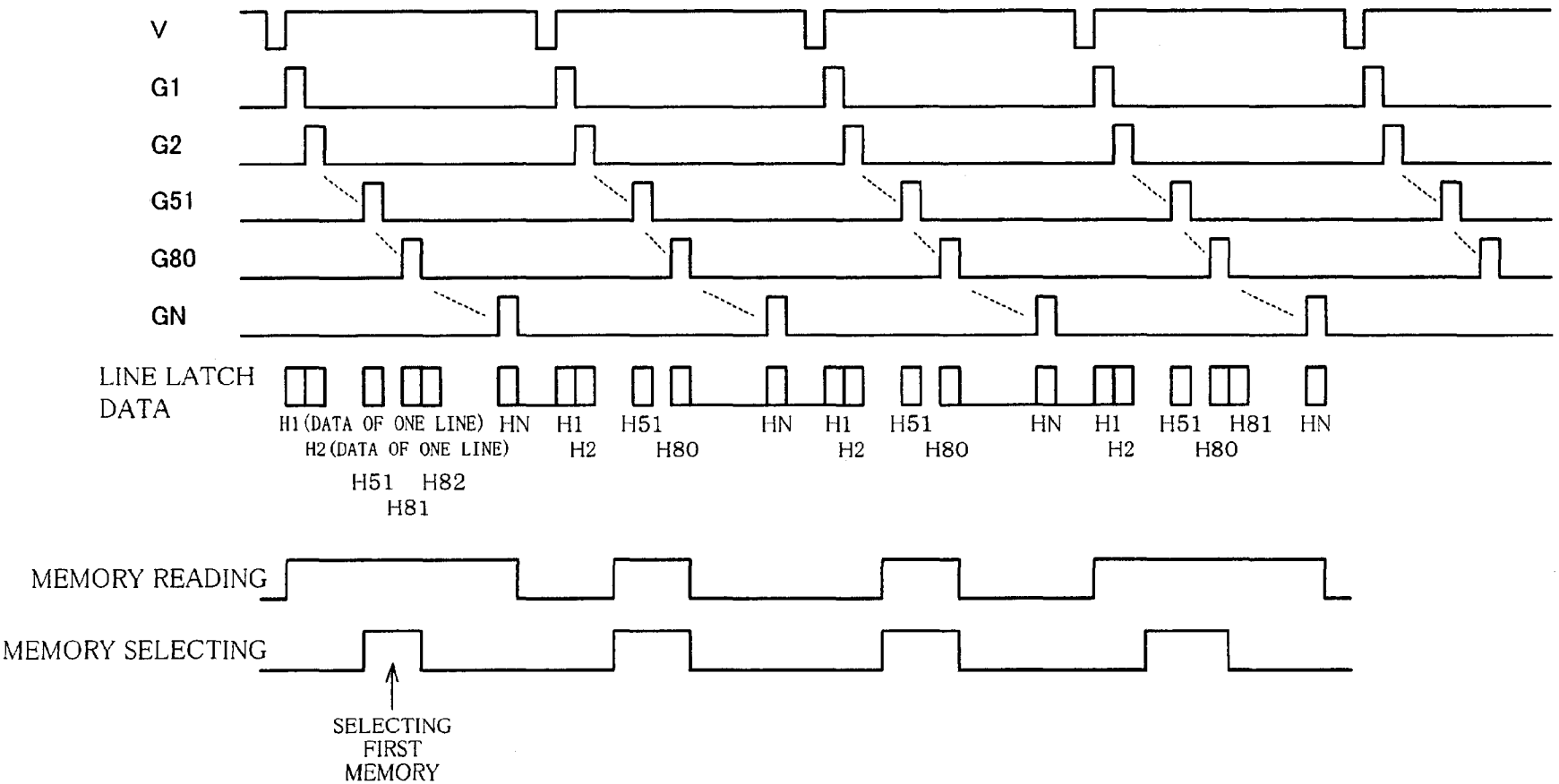
FIG. 12 is a chart showing timing of memory read-out for the example of display of the display section.

FIG. 12 illustrates relationship between a memory reading signal and a memory selecting signal in this case. Specifically, the memory selecting signal is of high level between a selection period of the gate line G51 and a selection period of the gate line G80, and display data stored in a first memory 24 is read out.

Here, stored in the first memory 24 are (i) display data for the black or white line (that is in black or in white), as line latch data for the gate lines G51 and G80, and (ii) display data for display of radio wave condition, battery condition, time and the like, as line latch data between a gate line G52 and a gate line G79.

Note that overwriting of the black or white line as needed is not required. Thus, the display data for the black or white line may be stored in the second memory 25 for storing the display data of the B area. In this case, (a) a method in which the display data for the gate lines G51 and G80 are stored in the second memory 25 and (b) a method in which the line latch data for the gate line G50 and G81, stored in the second memory 25 is used as the display data for the white or the black line.

In the method (a), the start line position of the area A is on the gate line G52, and the end line thereof is one gate line G79. Thus, the A area have a slightly narrow display area.

Moreover, in the method (b), the line latch data for the gate lines G50 and G81 is used as the display data for the black or white line. Thus, the display area of the A area is not narrowed.

In the method (a), as shown in FIG. 12, the memory selecting signal is of high level between the gate line G51 and the G80, whereas the memory selecting signal is of high level between the gate line G52 and G79.

Written into the A area is display data that need be overwritten as needed, such as radio wave condition, battery condition, and the like. Into the B area, display data for a single color such as white, black or the like is written batchwise as a kind of a waiting screen.

Here, it is important that the line is written, as a border line, on a border between the A area and the B area. For example, where the A area and the B area are identically in white, it is preferable that a white line is written on the border. However, even if a black line is written on the border instead of the white line, a color difference between the A area and the B area become less recognizable for human eyes. As a result, display quality is improved. Therefore, the border line to be written on the border between the A area and the B area is not particularly in terms of color. However, considering power consumption and easiness in displaying, a white line or a black line is preferable to be written, because display in black or white can be carried by turning ON and OFF a liquid crystal.

The above explains the case where (i) the display data of at least one frame to be written in the A area described in the first embodiment and (ii) the display data of at least one frame to be written in the B area are stored in the separate memories (the first memory 24 and the second memory 25). However, the present embodiment is not limited to this arrangement. For example, the present embodiment may be adopted in a case where display data of at least one frame for the A area and the B area combined together is stored in one memory.

In this arrangement, usually, a single color such as black or white is written batchwise in the B area, in many cases. Thus, the border between the A area and the B area becomes more visible. Thus, it is quite effective that the black or white line, which is different from the color of the B area, is written on the border between the A area and the B area.

Note that even in case where the A area and the B area are displayed respectively in different colors, the writing the line on the border between the A area and the B area distinguishes between the display of the A area and the display of the B area. Thus, display quality of the whole display screen is improved, compared with a case where no line is written on the border.

Each embodiment explains the liquid crystal display apparatus as the display apparatus. However, the present invention is not limited to this. A display apparatus using a TFD (Thin Film Diode), an electrophoretic element, or the like may used, as long as the display apparatus is of a hold-type.

Moreover, each embodiment explain the cases in which the display apparatus of the present invention is used as the display apparatus of the portable telephone. However, the present invention is not limited to this. The present invention may be adopted in other portable terminal apparatus, and the like.

Further, in each embodiment, a partial screen memory is provided in a storage section inside the display apparatus, the partial screen memory for storing therein data of at least one frame for the partial display area. It is not necessary that the partial screen memory is provided in the storage section. For example, if the display apparatus is used in a portable telephone, it may be arranged that data of at least one frame for the partial display area is downloaded sequentially, and written directly in the partial display area. With this arrangement, it is also unnecessary that the whole screen memory is provided in the storage section.

Therefore, overall size of the apparatus can be miniaturized and be thinner, by setting so that necessary data is downloaded as necessary, as described above.

As described above, a display apparatus of the present invention is provided with an image display section for performing display of data written in the image display section, the data being held thereon for a predetermined holding period; a full screen memory for storing therein data of at least one frame for a whole display area of the image display section; a partial screen memory, provided in addition to the full screen memory, for storing therein data of at least one frame for a partial display area; an image-display-section refreshing section for refreshing the data written in the image display section; a partial-display-area refreshing section for refreshing data written in the partial display area, after the data is held for a period shorter than the holding period of the image display section; and a control section for (i) causing data read out from the respective memories, to be written into the display areas to which the data corresponds, and (ii) causing the partial display area to move to an predetermined position within a display screen of the image display section when a predetermined time lapses.

As described above, a display method includes the steps of: displaying, on an image display section, data written into the image display section, the data being held thereon for a predetermined holding period; storing, in a full screen memory, data of at least one frame for a whole display area of the image display section; storing, in a partial screen memory, but not in the full screen memory, data of at least one frame for a partial display area; refreshing data written in the image display section; refreshing data written in the partial display area after the data written in the partial display area is held for a period shorter than the holding period of the image display section; writing, data of at least one frame in the partial display area, the data being other than data of at least one frame to be written into the whole display area; and moving the partial display area to an predetermined position within a display screen of the image display section when a predetermined time lapses.

According to the above arrangement and the above method, by moving the partial display area to the predetermined position within the display screen of the image display section when the predetermined time lapses, it is possible to prevent sticking of the image on the image display section.

Hereby, it is possible to prevent deterioration of display quality due to the sticking of the image on the image display section. The time interval of the movement of the partial display area is not particularly limited, provided that the time interval allows a user to see and check the data displayed on the partial display area.

Moreover, the data to be written in the whole display area of the image display section, and the data to be written in the partial display area are stored in separate memories in a storage section. Therefore, it is possible to control, independently of each other, writing of the data into the display area of the image display section, and writing of the data into the partial display area. Because of this, it is possible to display an image that is desired by a user, on an area that is considered as a non-display area when the partial display is performed.

Further, in the case where the partial display area is moved for preventing the sticking of the image, in an area to which the partial display area is moved, data stored in a partial screen memory is read out and the data that has been written in the area is overwritten with the data thus read out. In an area from which the partial display area has moved out, data stored in a whole screen memory is read out, and the data that has been written in the area is overwritten with the data thus read out. Thus, the movement of the partial display area within the display screen of the image display section does not affect the image displayed on the area other than the partial display area.

Therefore, according to the above arrangement and the method, because the image that is desired by the user and is displayed on the area other than the partial display area, is not affected by the movement of the partial display area, the display quality will not be deteriorated even if the image display is performed on both the partial display area and the other display area. As a result, it is possible to improve the display quality of the image display section that can perform the partial display.

Here, in case where the arrangement and the method are adopted as a display apparatus and a display method of a portable telephone for example, a still image is so displayed on the image display section that the data is held for a long period, and the partial display area is set, on which information (time, radio condition, battery condition, and the like) that need be updated sequentially.

In this case, power consumption is higher in the partial display area than in the area other than the partial display area, because it is necessary that the data be updated sequentially in the partial display area. However, in the area other than the partial display area, after the writing of the data, the data is held for a predetermined (holding) period longer than data update interval (that is, a refresh interval) of the partial display area, and then refreshed. Therefore, only small overall power consumption is necessary.

Therefore, according to the above arrangement and method, the power consumption is lowered compared with a case where the whole image display section is the partial display area, and as a result, the overall power consumption of the display apparatus and the display method are lowered.

Examples of movement of the partial display area are listed below.

It may be so arranged that the control section causes the partial display area to move by shifting the partial display area line by line at an interval of the predetermined time.

It may be so arranged that the control section causes the partial display area to move by shifting the partial display area randomly at an interval of the predetermined time.

Because the image display area and the partial display area have the different holding periods of data, if the areas are displayed in the same color, the color in the image display area and the color in the partial display area become slightly different by the looks thereof, as the time lapses.

Moreover, human beings have such vision characteristics that slightly different colors look similar to human beings if a line is written on a border portion between the slightly different colors, so as to show clearly a border of the slightly different colors.

Therefore, it may be so arranged that the control section causes predetermined color data to be written, as a border line, on a border between the partial display area and another area.

By writing, in a border part between display areas having different holding period of data, the color data that is for showing the border line, the border between the display areas becomes clear. Moreover, even if the partial display area and the area other than the partial display area are in colors slightly different from each other, it is possible to cause the areas to look in the substantially same color apparently.

This prevents the deterioration of the display quality due to the inferior color caused by the lapse of time in the image display section provided with the partial display area. As a result, the display quality of the display apparatus is improved.

It is preferable that the line to be written as the border line is in black or white, considering the power consumption and easiness in writing. However, no particular problem is caused even if the line is in another color.

In the display apparatus and the display method, the partial screen memory is provided in the storage section inside the display apparatus, the partial screen memory for storing the data of the at least one frame for the partial display area. However, the partial screen memory need not be located in the storage section. For example, in a case where the display apparatus is used in the portable telephone, it may be arranged such that the data of the at least one frame for the partial display area is downloaded sequentially, and directly written in the partial display area. Further, if it is arranged such that the data of the at least one frame for the whole display area of the image display section is down loaded and directly written in the whole display area, the whole screen memory also need not be located in the memory section.

In such apparatus and method, the memory for storing therein data that is to be displayed, can be provided externally, but not in a main body of the apparatus. This reduces a size, a thickness, and the like of the main body of the apparatus.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A display apparatus comprising:

an image display section for performing display of data written in the image display section, the data being held therein for a predetermined holding period;

a full screen memory for storing therein data of at least one frame for a whole display area of the image display section;

a partial screen memory, provided in addition to the full screen memory, for storing therein data of at least one frame for a partial display area which has a second refresh rate different from a first refresh rate of the whole display area and has a scan size different from a scan size of the whole display area;

an image-display-section refreshing section for refreshing at the first refresh rate the data written in the image display section;

a partial-display-area refreshing section for refreshing at the second refresh rate the data written in the partial display area, after the data is held for a period shorter than the holding period of the image display section; and a control section for (i) causing data read out from the respective memories, to be written into the display areas to which the data corresponds, and (ii) causing the partial display area to move to a predetermined position within a display screen of the image display section when a predetermined time lapses.

2. The display apparatus as set forth in claim 1, wherein:

the control section causes the partial display area to move by shifting the partial display area line by line at an interval of the predetermined time.

3. The display section as set forth in claim 1, wherein:

the control section causes the partial display area to move by shifting the partial display area randomly at an interval of the predetermined time.

4. A display apparatus comprising:

an image display section for performing display of data written in the image display section, the data being held therein for a predetermined holding period;

a full screen memory for storing therein data of at least one frame for a whole display area of the image display section;

a partial screen memory, provided in addition to the full screen memory, for storing therein data of at least one frame for a partial display area which has a second refresh rate different from a first refresh rate of the whole display area and has a scan size different from a scan size of the whole display area;

an image-display-section refreshing section for refreshing at the first refresh rate the data written in the image display section;

a partial-display-area refreshing section for refreshing at the second refresh rate the data written in the partial display area, after the data is held for a period shorter than the holding period of the image display section; and a control section for causing predetermined single color data to be written, as a border line, on a border between the partial display area and the whole display area.

5. The display apparatus as set forth in claim 4, wherein the color of the single color data is white.

6. The display apparatus as set forth in claim 4, wherein the color of the single color data is black.

7. The display apparatus as set forth in claim 4, wherein the color of the single color data is different from a color of the whole display area.

8. The display apparatus as set forth in claim 4, wherein the display apparatus is part of a portable telephone.

9. A display method comprising the steps of:

displaying, on an image display section, data written in the image display section, the data being held therein for a predetermined holding period;

storing, in a full screen memory, data of at least one frame for a whole display area of the image display section;

storing, in a partial screen memory, but not in the full screen memory, data of at least one frame for a partial display area which has a second refresh rate different from a first refresh rate, of the whole area and has a scan size different from a scan size of the whole display area;

refreshing at the first refresh rate the data written in the image display section;

refreshing at the second refresh rate the data written in the partial display area after the data written in the partial display area is held for a period shorter than the holding period of the image display section;

writing data of at least one frame in the partial display area, the data being other than data of at least one frame to be written into the whole display area; and moving the partial display area to a predetermined position within a display screen of the image display section when a predetermined time lapses.

10. The display method as set forth in claim 9, wherein: the partial display area is moved by shifting the partial display area line by line at an interval of the predetermined time.

11. The display method as set forth in claim 9, wherein: the partial display area is moved by shifting the partial display area randomly at an interval of the predetermined time.

12. A display method, comprising the steps of:

displaying, on an image display section, data written into the image display section, the data being held therein for a predetermined holding period;

storing, in a full screen memory, data of at least one frame for a whole display area of the image display section;

storing, in a partial screen memory, but not in the full screen memory, data of at least one frame for a partial display area which has a second refresh rate different from a first refresh rate, of the whole display area and has a scan size different from a scan size of the whole display area;

refreshing at the first refresh rate the data written in the image display section;

refreshing at the second refresh rate the data written in the partial display area after the data written in the partial display area is held for a period shorter than the holding period of the image display section; and writing predetermined single color data, as a border line, on a border between the partial display area and the whole display area.

13. The display method as set forth in claim 12, wherein the color of the single color data is white.

14. The display method as set forth in claim 12, wherein the color of the single color data is black.

15. The display method as set forth in claim 12, wherein the color of the single color data is different from a color of the whole display area.

16. A display apparatus comprising:

a display section comprising pixels coupled to gate lines and signal lines;

a full screen memory storing image data for a whole display area of the display section;

a partial screen memory, provided in addition to the full screen memory, storing image data for a partial display area of the display section; and a control section that writes image data from the full screen memory to a first display area of the display section by supplying image data from the full screen memory to the signal lines and sequentially scanning first ones of the gate lines, and that writes image data from the partial screen memory to a second display area of the display section smaller than the first display area by supplying the partial screen image data to the signal lines and sequentially scanning second ones of the gate lines different than the first ones of the gate lines, wherein the control section refreshes the image data written to the first display area at a first refresh rate and refreshes the image data written to the second display area at a second refresh rate that is greater than the first refresh rate.

17. The display apparatus as set forth in claim 16, wherein the control section periodically changes the gate lines constituting the first and second ones of the gate lines so as to cause the second display area to move.

* * * * *